US009839858B1

(12) United States Patent
Perez

(10) Patent No.: US 9,839,858 B1
(45) Date of Patent: Dec. 12, 2017

(54) BOTTLE CAP SPINNING DEVICE

(71) Applicant: Rolando H Perez, Miramar, FL (US)

(72) Inventor: Rolando H Perez, Miramar, FL (US)

( * ) Notice: Subject to any disclaimer, the term of this patent is extended or adjusted under 35 U.S.C. 154(b) by 29 days.

(21) Appl. No.: 15/212,386

(22) Filed: Jul. 18, 2016

(51) Int. Cl.
*A63H 1/32* (2006.01)
*A63H 33/00* (2006.01)

(52) U.S. Cl.
CPC ..... *A63H 1/32* (2013.01); *A63H 33/00* (2013.01)

(58) Field of Classification Search
CPC ..... A63H 33/00; A63H 1/32; A63H 3/52
USPC ..... 426/115
See application file for complete search history.

(56) References Cited

U.S. PATENT DOCUMENTS 65,022 A * 5/1867 Sizer ..... A63H 1/32 446/254
152,671 A * 6/1874 Nebeker et al. ..... A63H 1/32 446/214
836,050 A * 11/1906 Pfleghardt ..... A63H 1/32 446/489
1,258,464 A * 3/1918 Riley ..... A63H 3/52 446/254
1,513,773 A * 11/1924 Thompson ..... A63L 367/10 473/576
2,161,154 A * 6/1939 Gertler ..... A63H 1/32 446/253
2,766,796 A * 10/1956 Tupper ..... A47G 23/03 206/216
3,367,484 A * 2/1968 Nelson ..... B65D 51/28 206/459.5
4,189,862 A * 2/1980 Lopez ..... A63H 1/32 446/254
4,583,651 A * 4/1986 Ostberg ..... B65D 51/24 215/228
6,050,438 A * 4/2000 Kovens ..... B65D 11/02 220/4.24
7,214,397 B1 * 5/2007 Renna ..... A23G 3/563 426/104

FOREIGN PATENT DOCUMENTS

CN 2448428 * 9/2001 ..... A63H 1/32

* cited by examiner

*Primary Examiner* — Erik Kashnikow
*Assistant Examiner* — Chaim A Smith
(74) *Attorney, Agent, or Firm* — Ruben Alcoba, Esq.

(57) ABSTRACT

A bottle cap spinning device and method of operation provides: a spinning toy for entertainment; a container for containing a liquid, a candy, or a medicine; and an edible component for consumption. A bottle contains a liquid. A bottle cap caps the bottle while containing the candy and medicine. The bottle separates into a proximal cylinder, a distal cylinder, and a hub that positions between the cylinders. An edible member encapsulates the hub. A cord extends between the cylinders and carries the hub. Twisting the cord in a first direction generates torque, causing the hub to be rotatably carried towards the proximal cylinder. Twisting the cord in a second direction releases momentum from the torque, rotatably carrying the hub towards the distal cylinder. The cord is manipulated by rotating the cylinders. Drawing the cord taut or slackening the cord increases and decreases the angular and linear velocity of the hub.

20 Claims, 9 Drawing Sheets

BOTTLE CAP SPINNING DEVICE

BACKGROUND

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The present invention is directed to a bottle cap spinning device and method of operation that operates in combination of: a spinning toy for entertainment; a container for containing a liquid, candy, or medicine; and an edible component for consumption.

The inventor of the present invention has extensive experience with toys, and especially traditional mechanical toys. The inventor recognized that in the modern world, children are more prone to playing with digital games than with physical products. The inventor realized that he somehow had to again teach a child to play with physical products, for physical products develop coordination and physical skills that a digital game could never offer the child.

He remembered that in his youth he played with a toy that is similar to the toy described in U.S. Pat. No. 2,161,154 that was issued to I. Gertler. A simple toy that allowed children to grasp the extremities of a toy and manipulate the toy so that the toy could spin along a central axis. The toy was manipulated by the child in the manner described in the Gertler patent. The present invention uses at least a portion of the mechanism of the Gertler patent.

The inventor recognized a problem in that the spinning motion of the toy required mechanical energy to operate efficiently. The inventor knew that when a cord was twisted in a first direction, torque and momentum were built up within the cord. And when the cord was released, the momentum forced the cord to twist in an opposite direction.

The inventor decided to use this phenomena to enable a hub, including an edible member, to move along the length of the cord from extreme ends of the toy. The cord could also be drawn taut or slackened to change the angular and linear velocity of the spinning middle portion and edible member. This manipulation of the cord provided a challenging exercise that enhanced motor skills and provided entertainment.

The inventor recognized another problem in that the toy had to be more alluring for a child, going beyond just a spinning toy. The inventor devised a manner of introducing a physical spinning toy to a child in a manner in which the child would not be led to believe that he was being forced to play with a physical product. The physical product would then serve to increase the child's motor skills.

By housing an edible member, such as candy or gum, in the center of the toy and allowing the edible member to spin, the child would be swayed fascinated by the spinning motion and the edible member; thereby causing the child to purchase the toy. Further, after the edible member is consumed, the inventor believes that the child would eventually use the dispenser as a toy. The inventor further decided to add a bottle that coupled to the spinning toy. Thus, a liquid could also be stored for consumption. This would further enhance the possibilities of the device.

For the foregoing reasons, there is a need for an edible spinning device that provides: a spinning toy for entertainment; a container for containing candy or medicine; and an edible component for consumption.

Spinning toys and candy surprises have been utilized in the past; yet none with the characteristics of the present invention. See U.S. Pat. Nos. 1,804,260; 2,161,154; and 7,531,197.

For the foregoing reasons, there is an edible spinning device and method of operation that is configured into a multi-functional spinning toy, storage container, and edible component. Specifically, the device is configured to operate as: 1) a spinning toy for providing entertainment and developing motor skills; 2) a container for containing a liquid, a candy, and a medicine; and 3) an edible component for consuming a portion of the device.

SUMMARY

The present invention describes a bottle cap spinning device that offers multi-functionality, including operation as: a bottle for storing liquids; a bottle cap for capping the bottle; a bottle cap for containing an edible member; and a bottle cap with spinning interactive components for providing entertainment and developing motor skills.

In one embodiment, the bottle cap spinning device provides a bottle for containing and consuming a liquid. The bottle cap spinning device also provides a simple to operate bottle cap that detachably caps the bottle. The bottle cap is unique in that it is multi-functional: capping a bottle, containing a candy or medicine, and operating as a spinning toy.

The bottle cap easily separates into a proximal cylinder, a distal cylinder, and a hub that is disposed between the cylinders. The proximal cylinder, the distal cylinder, and the hub are configured to both, come together to form the bottle cap, or separate to operate as a spinning toy.

In one embodiment, the proximal cylinder, the distal cylinder, and the hub combine to form a useful container to enable candy and medicine to be stored, carried, filled, and dispensed. A gate in the proximal cylinder regulates access to the candy and medicine. In another embodiment, the proximal cylinder, the distal cylinder, and the hub separate to form a spinning toy that spins the hub about a cord, while oscillating between the cylinders. The angular and linear velocity of the hub is controlled through manipulation of the cord.

The cord passes through a channel in the hub to connect the proximal cylinder to the distal cylinder. While being carried on the cord, the hub may be rotatably manipulated between the proximal cylinder and the distal cylinder. The hub oscillates between leveraging the torque generated from twisting the cord, and releasing momentum from the twisted cord to spin towards extreme ends of the bottle cap. The torque and released momentum generated by the cord creates a spinning and linear motion across the hub. The cord is manipulated through rotation of the cylinders. An angular velocity and a linear velocity of the spinning hub can be regulated through manipulation of the cord.

An edible member at least partially encapsulates the hub. The edible member may be consumed before or after playing with the device. The edible member also adds weight to the hub for increased angular and linear velocity.

In one embodiment, the device comprises a bottle for containing and dispensing a liquid. The bottle is defined by a wide end and a narrow end. The narrow end of the bottle terminates at an opening having a rim. The rim may be threaded or may have a flange for coupling to the bottle cap.

In another embodiment, the device comprises a bottle cap defined by a cavity for containing a candy or a medicine. The bottle cap separates into a proximal cylinder, a distal cylinder, and a hub. The proximal cylinder is defined by an outer wall, an inner wall, a cap end, a first cord end, a first platform, and a capping member.

The inner wall of the proximal cylinder is configured to detachably attach to the rim of the bottle, either through a rotatable engagement or a friction fit engagement. The inner wall and the outer wall are disposed in a spaced-apart relationship that forms a gap. The first platform is disposed perpendicularly across the inner wall. The first platform forms a foundation for anchoring to the cord. A first anchor may be disposed at the first platform. The capping member is disposed to extend from the first platform towards the cap end of the proximal cylinder. The capping member has a frustoconical shape that fills the opening of the bottle and creates a seal that inhibits passage of liquid from the bottle.

The distal cylinder is defined by a continuous sidewall, a distal end, a second cord end, and a second platform. The continuous sidewall forms a generally circular shape. The second platform is disposed perpendicularly across the continuous sidewall. The second platform forms a foundation for anchoring to the cord. A second anchor may be disposed at the second platform.

In some embodiments, a gate may be disposed at the capping member of the proximal cylinder. The gate regulates access to the cavity of the bottle cap for accessing or filling the bottling cap with candy or medicine.

A hub is disposed between the proximal cylinder and the distal cylinder. The hub may include a hub sidewall and a spoke having at least one channel. The hub sidewall has a generally circular shape and mates with each cylinder from opposite edges of the hub sidewall. In some embodiments, an edible member at least partially encapsulates the hub. The edible member is configured to be edible, and may include a hard candy, a gum, and a licorice.

A cord extends between the first anchor at the first platform of the proximal cylinder and the second anchor at the second platform of the distal cylinder. The cord concentrically passes through the channel of the spoke, so as to carry the hub and the edible member, and allow free linear movement of the hub along the length of the cord.

The cord may be twisted by rotating the cylinders in a first or second direction. The cord may be twisted in a first direction to generate torque and rotatably carry the hub towards the proximal cylinder. The cord may be twisted in a second direction to release momentum from the generated torque and rotatably carry the hub towards the distal cylinder.

In operation of the device as a container, the bottle comprises a cavity for containing a candy, or a medicine, or both. The candy or medicine may be accessed through a gate that forms in the capping member of the proximal cylinder. Additionally, the candy or medicine may be filled into the cavity by separating the bottle cap into the proximal cylinder, distal cylinder, and hub, or depositing the candy or medicine into the gate.

In operation of the device as a spinning toy, the cord may be manipulated to twist in two directions. As the cord twists in a first direction, the hub and the edible member rotate and are carried along the length of the cord towards the proximal or distal cylinder, depending on the direction of the twisting by the cord. The twisting action in the first direction creates torque in the cord, which carries the hub and the edible member lengthwise along the cord, either towards the proximal cylinder or towards the distal cylinder.

After twisting in the first direction, momentum gained by the cord and the weight of the hub and the edible member force the cord to twist in a second direction; thereby causing the hub and the edible member to move lengthwise along the cord in an opposite direction. The angular velocity and the linear velocity of the hub and the edible member about the cord may be increased by manipulating the cord to draw the cord taut, or decreased by manipulating the cord to slacken the cord.

In operation of the device as an edible component, the edible member may be consumed upon separating the cylinders from the hub. The edible member may be consumed before or after playing with the bottle cap spinning device. It is significant to note that the bottle cap continues operating as a container, and the hub, cylinders, and cord continue operating as a spinning toy, even after the edible member has been consumed.

In some embodiments, a method for operating an edible spinning device comprises an initial Step of containing a liquid in a bottle.

In some embodiments, a Step may include detachably capping the bottle with a bottle cap. A Step comprises containing a candy or a medicine in a cavity of the bottle cap.

A further Step includes dispensing the candy or medicine through at least one gate of the bottle cap. Another Step may include separating the bottle cap into a proximal cylinder, a distal cylinder, and a hub, the hub at least partially encapsulated by an edible member.

A further Step includes extending a cord between the proximal cylinder and the distal cylinder. Another Step may include passing the cord through a channel in a spoke of the hub.

A further Step includes twisting the cord in a first direction to generate torque and rotatably carry the hub towards the proximal cylinder. Another Step may include twisting the cord in a second direction to release momentum from the generated torque and rotatably carry the hub towards the distal cylinder. A final Step comprises consuming the edible member.

One objective of the present invention is to provide a bottle cap that serves the multi-purpose of capping a bottle, containing candy or medicine, and operating as a spinning toy.

Another objective of the present invention is to provide a bottle that contains a liquid for consumption.

Another objective of the present invention is to provide an entertaining spinning toy that is at least partially edible.

Another objective of the present invention is to regulate access to the candy or medicine in the bottle cap through a gate.

Yet another objective of the present invention is to generate sufficient torque on a cord, such that the hub and the edible member are rotatably carried to the proximal cylinder or the distal cylinder.

Yet another objective is to release momentum from the generated torque, such that the hub and the edible member are rotatably carried towards the proximal cylinder or the distal cylinder.

Yet another objective is to consume the edible member either after or before playing with the device.

Yet another objective is to enable the cord to be manipulated so that the angular velocity and linear velocity of the hub and the edible member are increased or decreased.

Yet another objective of the present invention is to provide a candy or pill dispenser that converts into a toy after the candy or pill is consumed.

Another objective of the present invention is to provide a physical toy to a child that will allow the child to improve his or her motor skills.

Yet another objective of the present invention is to provide a child with a non-digital toy or game.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

DRAWINGS

These and other features, aspects, and advantages of the present invention will become better understood with regard to the following description, appended claims, and drawings where:

FIG. 2A is a side view, and FIG. 2B is the section taken along section A-A of FIG. 2A, detailing the engagement between a bottle and a bottle cap;

DESCRIPTION

The present invention is directed to a bottle cap spinning device 100 and method 200 of operation, as referenced in FIGS. 1-9. The bottle cap spinning device 100, hereafter "device 100" provides a bottle 102 and a bottle cap 110 that work together to store a liquid, candy, medicine, and an edible member (not shown) for consumption. The bottle cap 110 can also be separated to operate as a spinning toy for entrainment and developing motor skills.

In one embodiment, the device 100 is multifunctional, operating as: 1) a container for containing a liquid; 2) a container for containing a candy and a medicine; 3) a spinning toy for providing entertainment and developing motor skills; and 4) an edible component for consuming a portion of the device 100. Suitable materials for the device 100 may include, without limitation, a rigid polymer, polyurethane, a metal, wood, and fiberglass.

Figure 1:
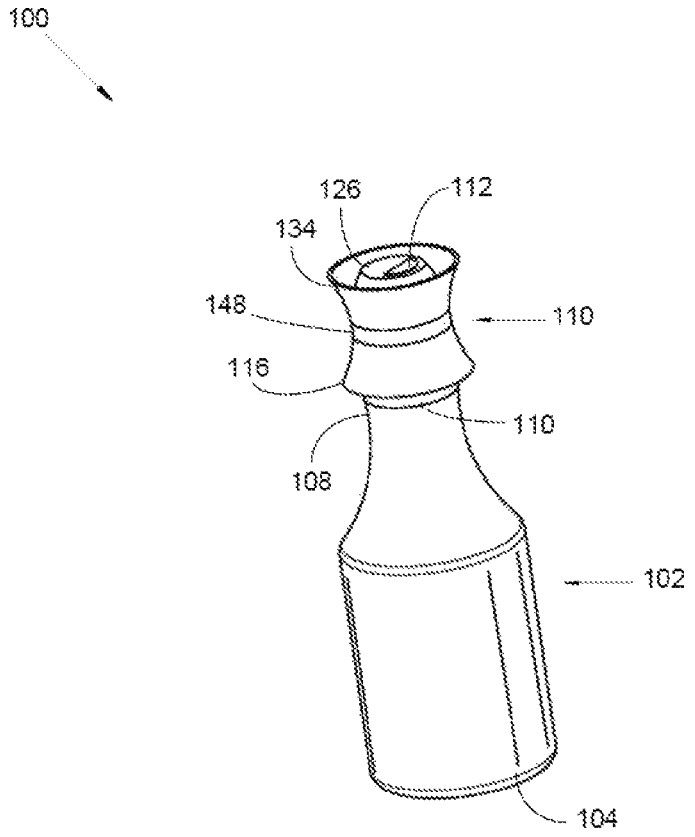
FIG. 1 is a perspective view of an exemplary bottle cap spinning device.

As FIG. 1 illustrates, the device 100, as used as a container, provides a bottle cap 110 that securely and safely contains candy and medicine for storage, portability, refilling, and dispensing. The candy and medicine may be filled and dispensed through a gate 112 in the bottle cap 110. The candy and medicine may also be filled and dispensed by disassembling the bottle cap 110.

The bottle cap 110, when utilized as a spinning toy, separates into multiple components to enable spinning a hub 148 between a proximal cylinder 116 and a distal cylinder 134. The hub 148 spins about a cord 114 oscillating between the cylinders 116, 134. The hub 148 leverages the torque generated from twisting the cord 114 in a first direction, and releasing momentum from the twisted cord 114 in a second direction to generate angular and linear velocity that enable the hub to spin towards each cylinder 116, 134. Thus, the torque and released momentum generated from twisting the cord 114 creates a spinning motion and a linear motion on the hub 148.

The cord 114 is manipulated through rotation of the proximal and distal cylinders 116,134. The angular velocity and the linear velocity of the hub 148 may be increased or decreased by manipulating the cord 114 through rotation of the cylinders 116,134, i.e., drawing the cord 114 taut or slackening the cord 114. This manipulation of the cord 114 helps develop motor skills and also provides entertainment as a user attempts to maintain spinning of the hub 148 between the cylinders 116,134.

The device 100, when as used as an edible component, provides an edible member that encapsulates the hub 148. The edible member may be consumed either before or after playing with the device 100. The edible member may also be effective for providing weight to increase the angular and linear velocity of the spinning hub 148. The edible member may include, without limitation, a hard candy, a gum, a chocolate, a medicine, a tablet, and a small toy.

Figures 2A, 2B:
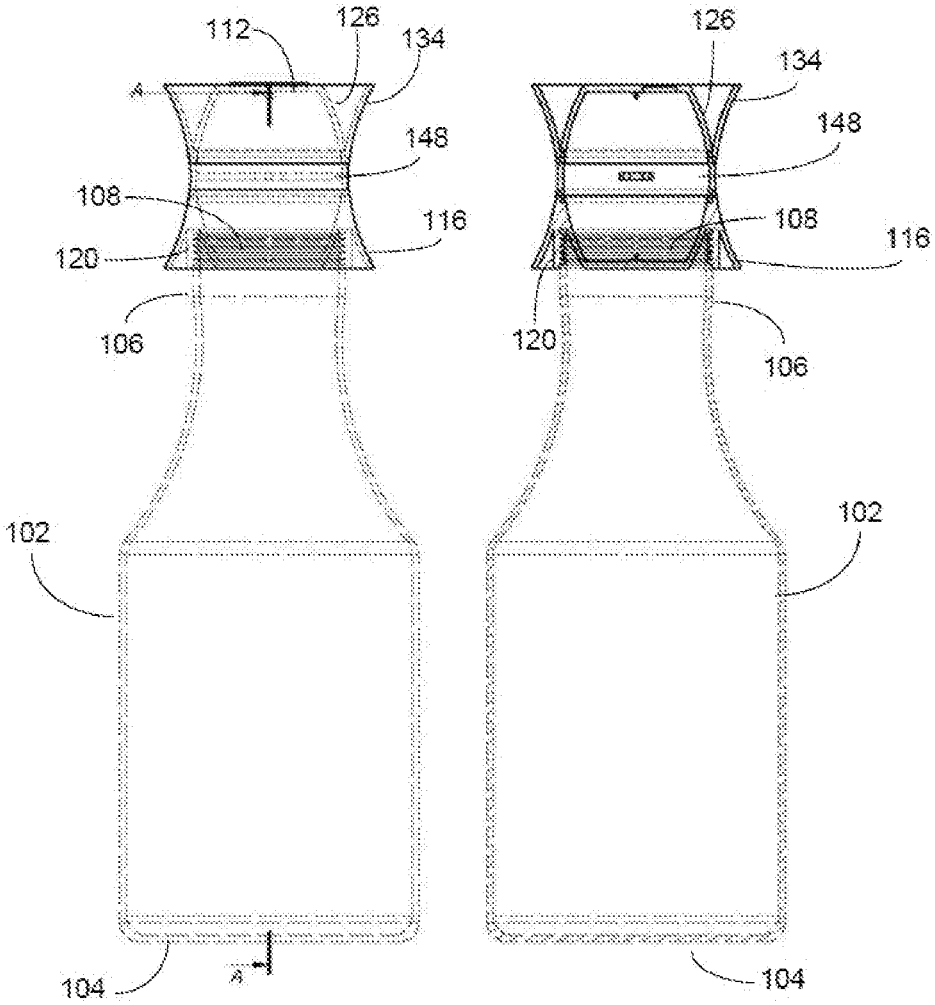
FIGS. 2A and 2B are sectioned side views of the bottle cap spinning device, where

As referenced in FIG. 2A, the device 100 provides a bottle 102 for containing and consuming a liquid. The bottle 102 is defined by a wide end 104 and a narrow end 106. The wide end 104 is sufficiently wide to form a stable base for supporting the device 100. The narrow end 106 of the bottle 102 terminates at an opening (not shown) that is sized and dimensioned to enable drinking directly from the bottle 102. The narrow end 106 of the bottle 102 may have a rim 108.

The bottle 102 is configured to contain a liquid and enable consumption of the liquid directly through the opening at the narrow end 106 of the bottle 102. Suitable materials for the bottle 102 may include, without limitation, glass, plastic, wood, fiberglass, and a synthetic material.

Looking at the sectioned view of FIG. 2B, the rim 108 at the opening of the narrow end 106 may be threaded or may have a flange. When threaded, the rim 108 rotatably engages a threaded inner wall of a distal cylinder 134 to seal the bottle cap 110 to the bottle 102. However, the rim 108 may also have a flange that mates with a ridge in a ridged inner wall of the distal cylinder 134.

The device 100 also provides a simple to operate bottle cap 110 that detachably caps the bottle 102. In this manner, the bottle cap 110 prevents liquid from spilling through the opening. The bottle cap 110 has a generally narrow middle section and a pair of wide extreme ends. In addition to capping the bottle 102, the bottle cap 110 stores candy or medicine in a cavity.

The bottle cap 110 may be separated into a proximal cylinder 116, a distal cylinder 134, and a hub 148. The hub 148 is disposed between the cylinders 116,134. The proximal cylinder 116, the distal cylinder 134, and the hub 148 are configured to both, come together to form the bottle cap 110 and provide containing means, or separate to operate as a spinning toy. Thus, the bottle cap 110 serves the multipurpose of capping the bottle 102, containing candy or medicine, and operating as a spinning toy.

Figure 3:
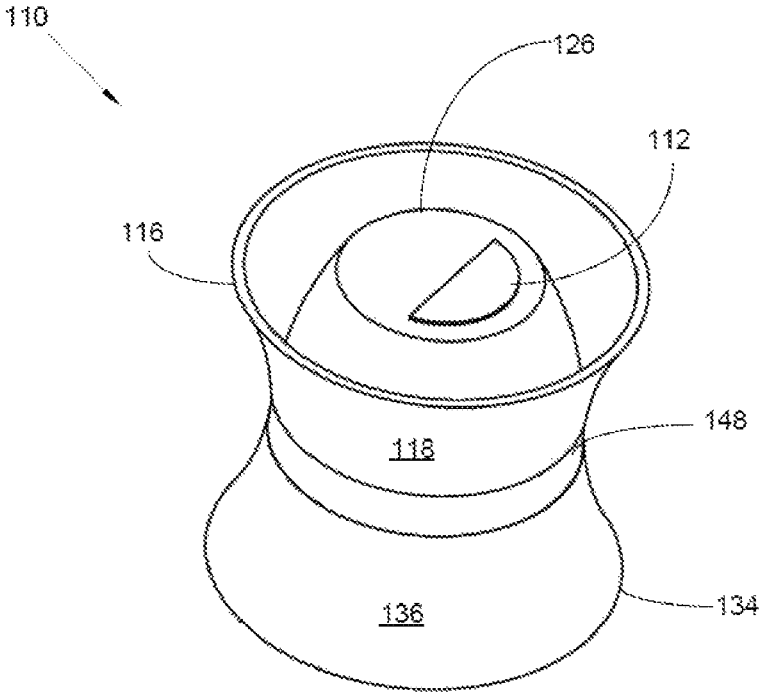
FIG. 3 is a perspective view of a proximal cylinder from the bottle cap disposed in a vertical disposition.

Turning now to FIG. 3, the proximal cylinder 116 is defined by an outer wall 118, an inner wall 120, a cap end 124, a first cord end 130, a first platform (not shown), and a capping member 126. The proximal cylinder 116 has a generally cylindrical shape. Though in other embodiments, other shapes may be used to accommodate the bottle or alter the spinning toy.

The inner wall 120 of the proximal cylinder 116 is configured to detachably attach to the rim 108 of the bottle 102, either through a rotatable engagement or a friction fit engagement. In one embodiment, the rim 108 is threaded, and the inner wall 120 is threaded, so as to enable rotational coupling and decoupling between the bottle 102 and the bottle cap 110.

Figure 4:
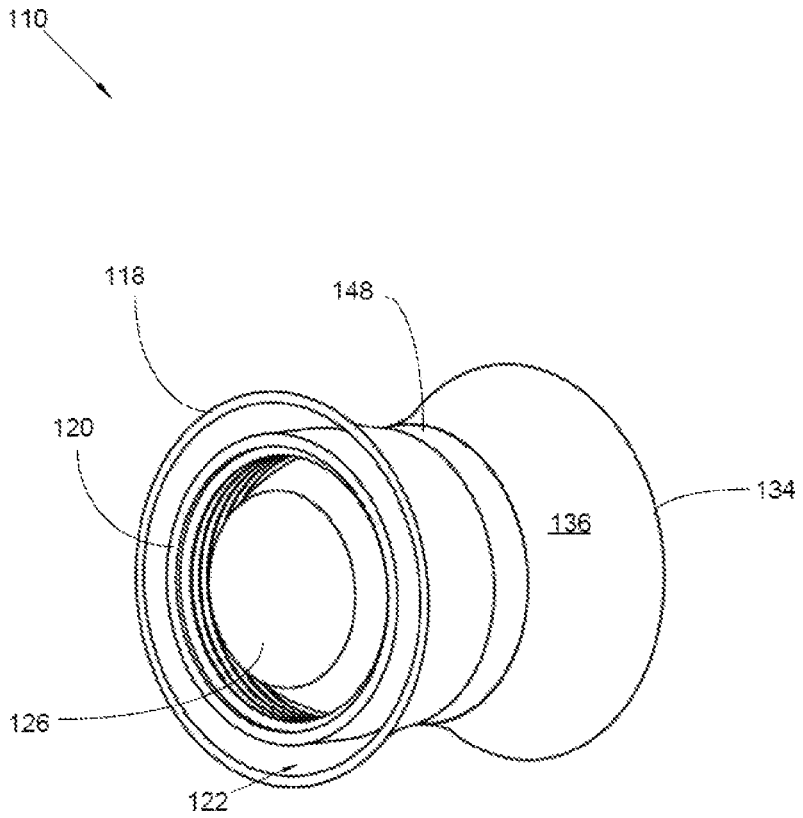
FIG. 4 is a perspective view of the proximal cylinder from the bottle cap disposed in a horizontal disposition.

As FIG. 4 illustrates, the inner wall 120 and the outer wall 118 are disposed in a spaced-apart relationship that forms a gap 122. The outer wall 118 forms a generally circular shape around the inner wall 120. The first platform is disposed perpendicularly across the inner wall 120. The first platform forms a foundation for a first end 128 of the cord 114 to anchor to the proximal cylinder 116. A first anchor (not shown) may be disposed at the first platform to provide the anchoring means. The first anchor may include a U-shaped bolt or other anchoring means known in the art.

The capping member 126 is disposed to extend from the first platform towards the cap end 124 of the proximal cylinder 116. The capping member 126 may have a frusto-conical shape that fills the opening of the bottle 102. In one embodiment, the capping member 126 forms a snug, friction fit engagement with the rim 108 of the narrow end 106 of the bottle 102 to seal the opening.

Figure 5:
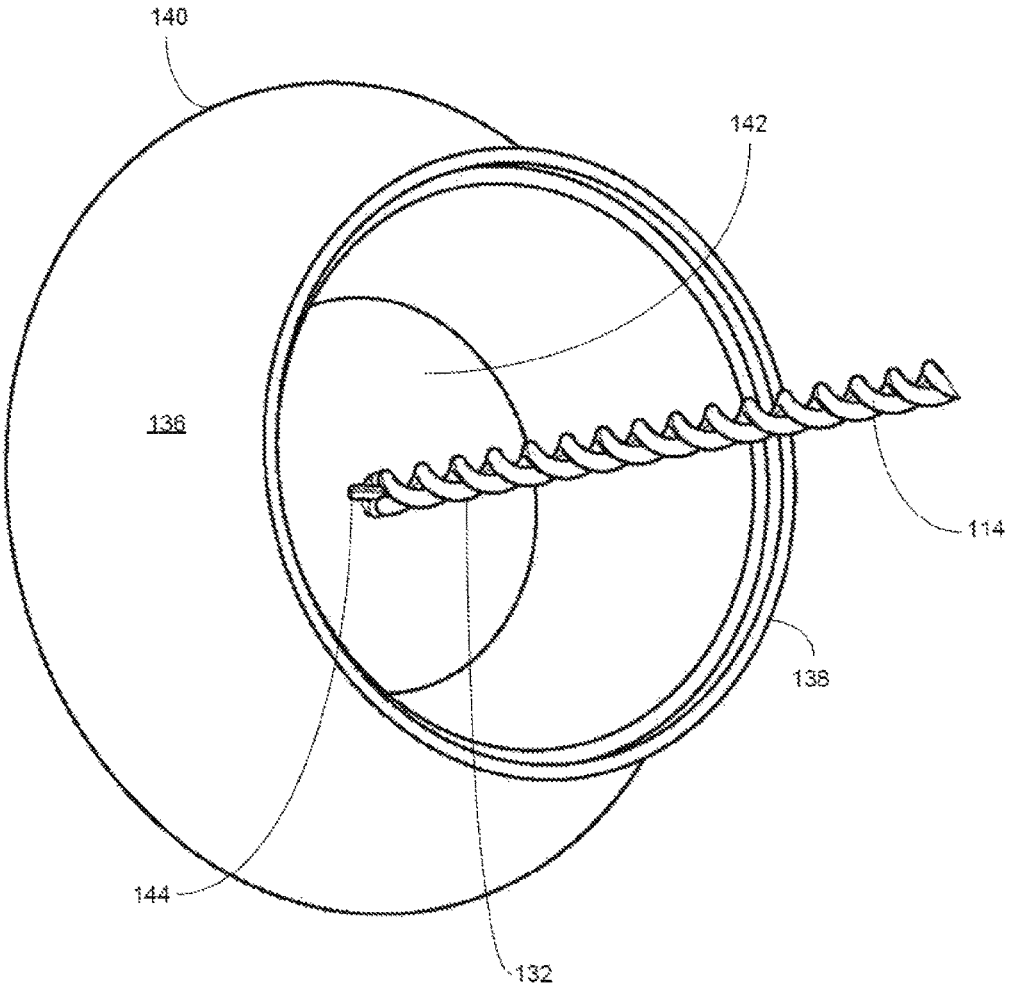
FIG. 5 is a perspective view of a distal cylinder from the bottle cap disposed in a horizontal disposition.

As shown in FIG. 5, the distal cylinder 134 is disposed oppositely the proximal cylinder 116. The distal cylinder 134 is defined by a continuous sidewall 136, a distal end 140, a second cord end 138, and a second platform 142. The second platform 142 is disposed perpendicularly across the continuous sidewall 136. The second platform 142 forms a foundation for enabling a second end 132 of the cord 114 to securely attach to the distal cylinder 134. A second anchor 144, similar to the first anchor may be disposed at the second platform 142. In some embodiments, each cylinder 116,134 may have a different color or pattern to provide greater entertainment value.

Looking back at FIG. 3, a gate 112 may be disposed at the capping member 126 of the proximal cylinder 116. The gate 112 regulates access to the cavity of the bottle cap 110 for accessing or filling the bottle cap 110 with the candy or medicine. The gate 112 may slide or hinge between an open position and a closed position. The open position enables the candy or the medicine to be dispensed or filled in the cavity of the bottle cap 110.

Figure 6:
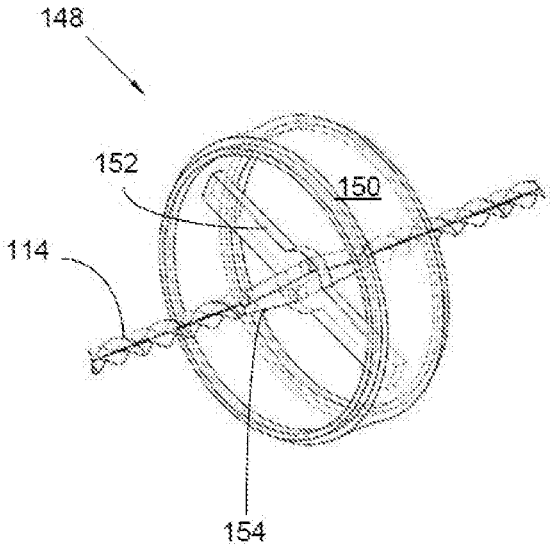
FIG. 6 is a perspective view of a hub from the bottle cap disposed in a vertical disposition.

Turning now to FIG. 6, the bottle cap 110 further comprises a hub 148. The hub 148 is disposed between the proximal cylinder 116 and the distal cylinder 134. However, when operating as a spin toy, the hub 148 moves freely along the cord 114 towards either one of the cylinders 116,134. The hub 148 has a generally circular shape. The hub 148 comprises a hub sidewall 150 having a pair of opposite edges that detachably engage each cylinder. The hub sidewall 150 and the cylinder walls 118,136 may have beveled edges to facilitate connections therebetween.

For example, the outer wall 118 of the proximal cylinder 116 has a first beveled edge and the hub sidewall 150 has a second beveled edge that is configured to mate with the first beveled edge of the proximal cylinder 116 in a snap-fit engagement. A spoke 152 extends perpendicularly across the hub sidewall 150. The spoke 152 may have a generally flat, elongated shape. The hub 148 may include a channel 154 that is sized and dimensioned to enable passage of the cord 114.

In some embodiments, an edible member may at least partially encapsulates the hub 148. In another embodiment, the edible member forms a thin layer around the hub 148. The edible member may be chewed or licked for consumption. The edible member also adds weight to the hub 148, so that the angular velocity and linear velocity of the hub 148 increases during spinning functions. The edible member may include, without limitation, a hard candy, a gum, a chocolate, a medicine, a tablet, and a small toy.

Figure 7:
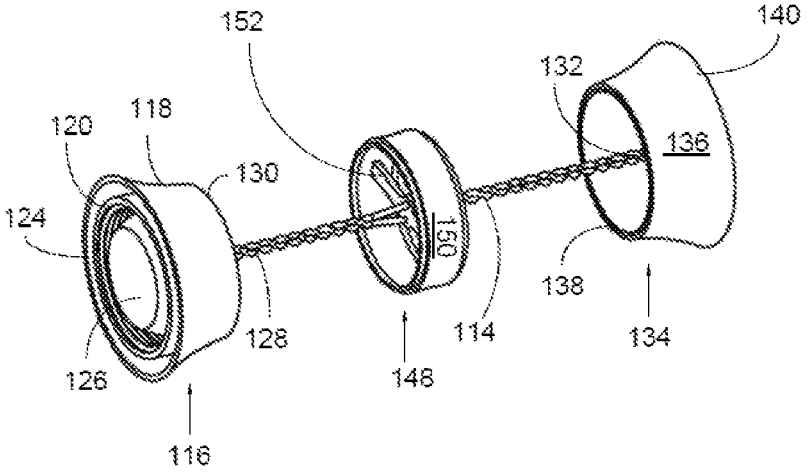
FIG. 7 is a perspective view of the bottle cap separating into the proximal cylinder, the hub, and the distal cylinder, with a cord carrying the hub.

As illustrated in FIG. 7, a cord 114 extends between the first anchor at the first platform of the proximal cylinder 116 and the second anchor 144 at the second platform 142 of the distal cylinder 134. The cord 114 also passes concentrically through the channel 154 of the spoke 152, so as to carry the hub 148 and the edible member. Suitable materials for the cord 114 may include, without limitation, a fiber, rubber, polyester, bamboo, and a polymer.

Figure 8:
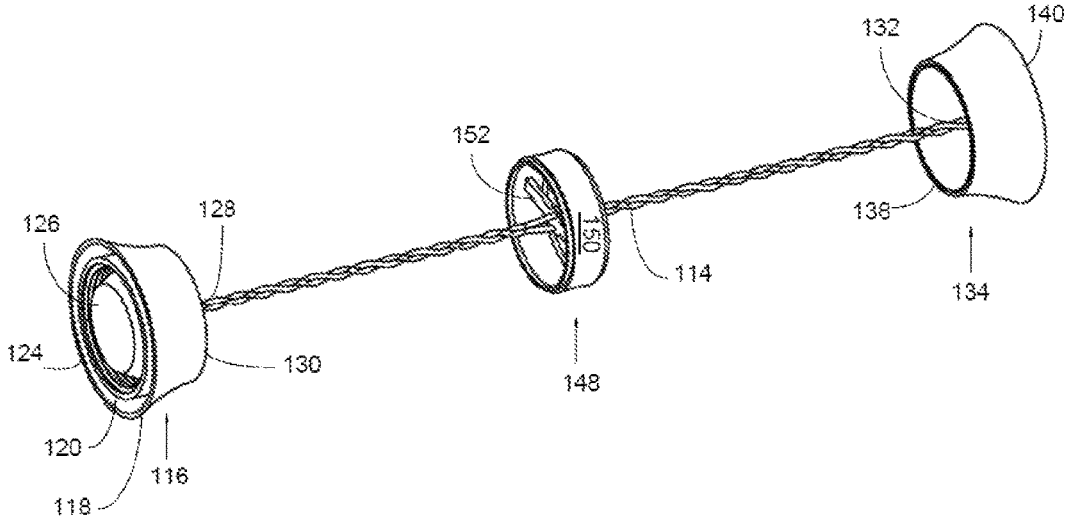
FIG. 8 is a perspective view of the bottle cap fully separated into the proximal cylinder, the hub, and the distal cylinder, with a cord carrying the hub.

Looking at FIG. 8, the cord 114 is configured to twist in a first direction so as to generate torque and gain momentum. The momentum on the cord 114 is released when the cord 114 is released, or is forced to twists in the second direction. The hub 148 rotates along the axis of the cord 114. The hub 148 also moves freely in two directions along the length of the cord 114. As the cord 114 twists in the first or second direction, the hub 148 is carried in either direction, dependent on the direction of the twisting motion. The cord 114 may be manipulated to alter the linear and angular velocity of the spinning hub 148.

While being carried on the cord 114, the hub 148 may be rotatably manipulated between the proximal cylinder 116 and the distal cylinder 134 to provide a unique spinning toy. The bottle cap 110 leverage the torque generated from twisting the cord 114 and the momentum released from the cord 114 to create a spinning and linear motion across the hub 148. The challenge involves maintaining a high velocity spin while carrying the hub between the cylinders 116,134.

The cord 114 may be twisted by rotating the cylinders 116,134 in a first or second direction. The cord 114 is twisted in a first direction to generate torque and rotatably carry the hub 148 towards the proximal cylinder 116. The cord 114 is released to twist in a second direction, so as to release momentum from the generated torque and rotatably carry the hub 148 towards the distal cylinder 134.

An edible member at least partially encapsulates the hub 148. The edible member adds weight to the hub 148 to increase the angular and linear velocity during spinning. The edible member may also be consumed before or after playing with the device 100.

In operation of the device 100 as a container, the bottle 102 contains a liquid. The bottle cap 110 comprises a cavity for containing a candy, or a medicine, or both. The candy or medicine may be accessed through a gate 112 in the capping member 126 of the proximal cylinder 116. Additionally, the candy or medicine may be filled into the cavity by separating the bottle cap 110 into the proximal cylinder 116, distal cylinder 134, and hub 148, or depositing the candy or medicine into the gate 112.

In operation of the device 100 as a spinning toy, the cord 114 may be manipulated to twist in two directions by rotating the cylinders 116,134. As the cord 114 twists in a first direction, the hub 148 and the edible member rotate and are carried along the length of the cord 114 towards the proximal or distal cylinder 134, depending on the direction of the twisting by the cord 114. The twisting action in the first direction creates torque in the cord 114, which carries the hub 148 and the edible member lengthwise along the cord 114, either towards the proximal cylinder 116 or towards the distal cylinder 134.

After twisting in the first direction, momentum gained by the cord 114 and the weight of the hub 148 and the edible member, work to twist the cord 114 in a second direction; thereby causing the hub 148 and the edible member to move lengthwise along the cord 114 in an opposite direction. The angular velocity and the linear velocity of the hub 148 and the edible member about the cord 114 may be increased by manipulating the cord 114 to draw the cord taut, or decreased by manipulating the cord to slacken the cord 114.

In operation of the device 100 as an edible component, the edible member may be consumed upon separating the cylinders from the hub 148. The edible member may be consumed before or after playing with the device 100. It is significant to note that the bottle cap 110 continues operating as a container, and the hub 148, cylinders 116,134, and cord 114 continue operating as a spinning toy, even after the edible member has been consumed.

Figure 9:
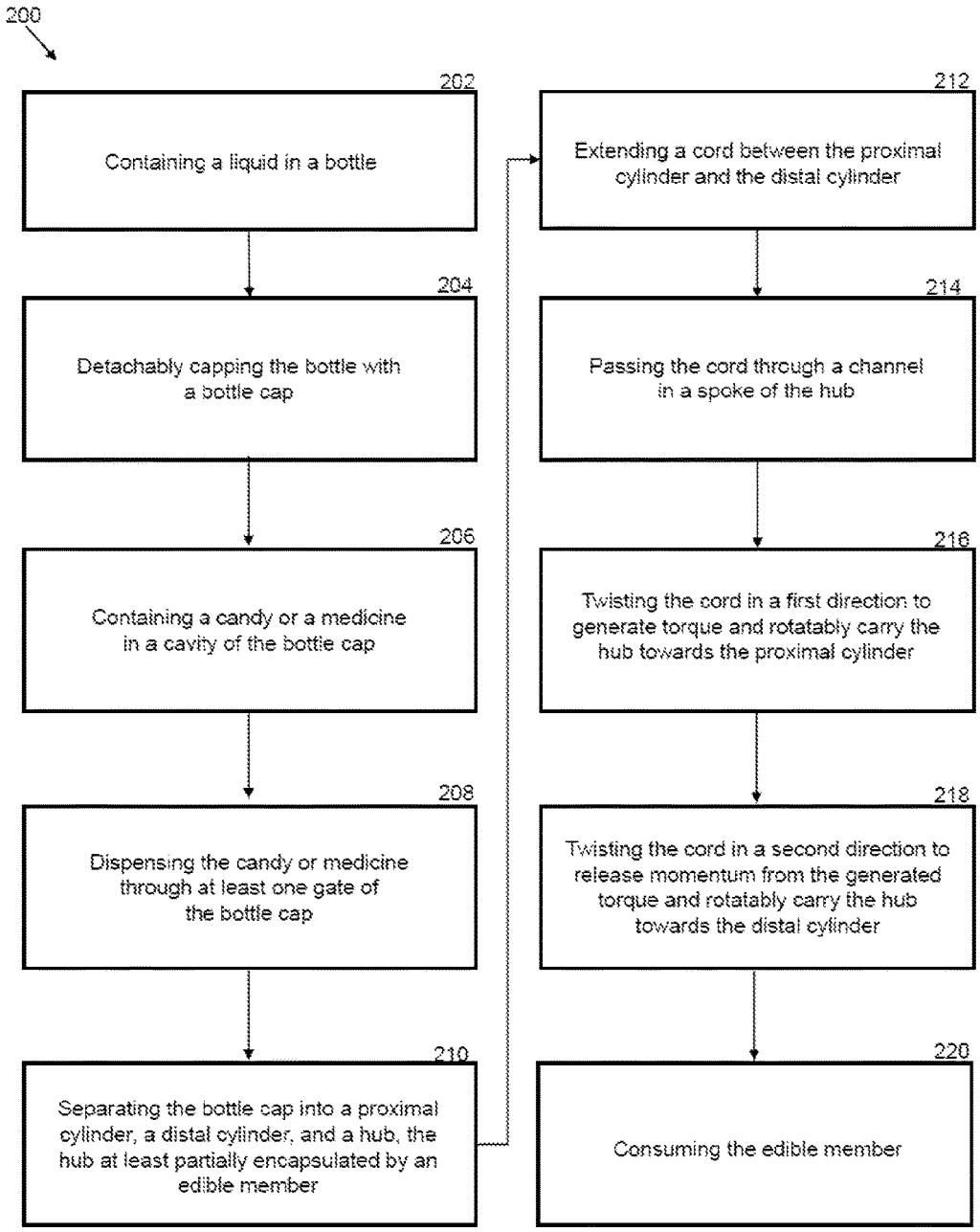
FIG. 9 is a flowchart of an exemplary method for operating a bottle cap spinning device.

As the flowchart of FIG. 9 references, a method 200 for operating a bottle cap spinning device 100 enables the utilization of a bottle cap spinning device 100 that functions as: a container for a liquid; a container for containing candy or medicine; a spinning toy for entertainment; and an edible component for consumption. In some embodiments, the method 200 comprises an initial Step 202 of containing a liquid in a bottle 102. The bottle 102 is defined by a wide end 104 and a narrow end 106. The wide end 104 is sufficiently wide to form a stable base for supporting the device 100. The narrow end 106 of the bottle 102 terminates at an opening (not shown) that is sized and dimensioned to enable drinking directly from the bottle 102. The narrow end 106 of the bottle 102 may have a rim 108.

In some embodiments, a Step 204 may include detachably capping the bottle 102 with a bottle cap 110. The bottle cap 110 detachably caps the bottle 102. In this manner, the bottle cap 110 prevents liquid from spilling through the opening of the bottle 102. The bottle cap 110 has a generally narrow middle section and a pair of wide extreme ends. In addition to capping the bottle 102, the bottle cap 110 stores candy or medicine in a cavity.

A Step 206 comprises containing a candy or a medicine in a cavity of the bottle cap 110. A further Step 208 includes dispensing the candy or medicine through a gate 112 of the bottle cap 110. The gate can slidably or hingedly open and close to enable access to the cavity.

Another Step 210 may include separating the bottle cap 110 into a proximal cylinder 116, a distal cylinder 134, and a hub 148, the hub 148 at least partially encapsulated by an edible member. The bottle cap 110 may be separated into a proximal cylinder 116, a distal cylinder 134, and a hub 148. The hub 148 is disposed between the cylinders 116,134. The proximal cylinder 116, the distal cylinder 134, and the hub 148 are configured to both, come together to form the bottle cap 110 and provide containing means, or separate to operate as a spinning toy. Thus, the bottle cap 110 serves the multi-purpose of capping the bottle 102, containing candy or medicine, and operating as a spinning toy.

A further Step 212 includes extending a cord 114 between the proximal cylinder 116 and the distal cylinder 134. The cord 114 extends between the first anchor at the first platform of the proximal cylinder 116 and the second anchor 144 at the second platform 142 of the distal cylinder 134. Another Step 214 may include passing the cord 114 through a channel 154 in a spoke 152 of the hub 148. The cord 114 also passes concentrically through the channel 154 of the spoke 152, so as to carry the hub 148 and the edible member.

A further Step 216 includes twisting the cord in a first direction to generate torque and rotatably carry the hub 148 towards the proximal cylinder 116. As the cord 114 twists in a first direction, the hub 148 and the edible member rotate and are carried along the length of the cord 114 towards the proximal or distal cylinder 134, depending on the direction of the twisting by the cord 114. The twisting action in the first direction creates torque in the cord 114, which carries the hub 148 and the edible member lengthwise along the cord 114, either towards the proximal cylinder 116 or towards the distal cylinder 134.

Another Step 218 may include twisting the cord in a second direction to release momentum from the generated torque and rotatably carry the hub 148 towards the distal cylinder 134. After twisting in the first direction, momentum gained by the cord 114 and the weight of the hub 148 and the edible member, work to twist the cord 114 in a second direction; thereby causing the hub 148 and the edible member to move lengthwise along the cord 114 in an opposite direction. The angular velocity and the linear velocity of the hub 148 and the edible member about the cord 114 may be increased by manipulating the cord 114 to draw the cord taut, or decreased by manipulating the cord to slacken the cord 114. A final Step 220 comprises consuming the edible member. The edible member may be consumed either before or after playing with the device 100.

While the inventor's above description contains many specificities, these should not be construed as limitations on the scope, but rather as an exemplification of several preferred embodiments thereof. Many other variations are possible. For example, the device may utilize two middle sphere portions, two hubs, and two edible members adjacent to each other. Accordingly, the scope should be determined not by the embodiments illustrated, but by the appended claims and their legal equivalents.

What is claimed is:

1. A bottle cap spinning device that is used to cap a rim of a bottle, the device comprising:

a bottle cap defined by a cavity, the bottle cap configured to separate into a proximal cylinder, a distal cylinder, and a hub, the proximal cylinder defined by an outer wall, an inner wall, a cap end, a first cord end, a first platform, and a capping member, the inner wall configured to detachably attach to the rim of the bottle, the inner wall and the outer wall disposed in a spaced-apart relationship that forms a gap, the first platform disposed perpendicularly across the inner wall, the capping member disposed to extend from the first platform towards the cap end of the proximal cylinder, the capping member configured to cover the opening of the bottle, the distal cylinder defined by a continuous sidewall, a distal end, a second cord end, and a second platform, the second platform disposed perpendicularly across the continuous sidewall;

a hub disposed between the proximal cylinder and the distal cylinder, the hub comprising a hub sidewall and a spoke having at least one channel; and a cord configured to extend between the first platform of the proximal cylinder and the second platform of the distal cylinder, the cord further configured to pass through the channel of the spoke, whereby the cord is configured to twist in a first direction to generate torque and rotatably carry the hub towards the proximal cylinder, and whereby the cord is configured to twist in a second direction to release momentum from the generated torque and rotatably carry the hub towards the distal cylinder.

2. The device of claim 1, wherein the rim of the bottle is threaded.

3. The device of claim 2, wherein the inner wall of the proximal cylinder is threaded, wherein the threaded rim and the threaded inner wall rotatably mate.

4. The device of claim 1, wherein the capping member of the proximal cylinder has a frustoconical shape.

5. The device of claim 1, wherein the capping member of the proximal cylinder is configured to cover the opening of the bottle in a friction fit engagement.

6. The device of claim 1, wherein bottle cap is configured to enable containment of a candy or a medicine.

7. The device of claim 1, further including a gate disposed at the capping member of the proximal cylinder, the gate configured to regulate access to the cavity of the bottle cap.

8. The device of claim 7, wherein the gate slidably moves between an open position and a closed position.

9. The device of claim 1, further including a first anchor disposed at the first platform of the proximal cylinder, the first anchor joins with a first end of the cord.

10. The device of claim 1, further including a second anchor disposed at the second platform of the distal cylinder, the second anchor joins with a second end of the cord.

11. The device of claim 1, further including an edible member configured to at least partially encapsulate the hub.

12. The device of claim 11, wherein the edible member includes at least one member selected from the group consisting of: a hard candy, a gum, a chocolate, a medicine, a tablet, and a small toy.

13. The device of claim 1, wherein the hub is rotatably carried towards the proximal cylinder and the distal cylinder at an angular velocity and a linear velocity.

14. The device of claim 13, wherein the angular velocity and the linear velocity of the hub is increased by drawing the cord taut.

15. The device of claim 14, wherein the angular velocity and the linear velocity of the hub is decreased by slackening the cord.

16. A bottle cap spinning device that is used to cap a rim of a bottle, the device comprising:

a bottle cap defined by a cavity, the bottle cap configured to separate into a proximal cylinder, a distal cylinder, and a hub, the proximal cylinder defined by an outer wall, an inner wall, a cap end, a first cord end, a first platform, and a capping member, the inner wall configured to detachably attach to the rim of the bottle, the inner wall and the outer wall disposed in a spaced-apart relationship that forms a gap, the first platform disposed perpendicularly across the inner wall, the capping member disposed to extend from the first platform towards the cap end of the proximal cylinder, the capping member configured to cover the opening of the bottle, the distal cylinder defined by a continuous sidewall, a distal end, a second cord end, and a second platform, the second platform disposed perpendicularly across the continuous sidewall;

a gate disposed at the capping member of the proximal cylinder, the gate configured to regulate access to the cavity of the bottle cap;

a first anchor disposed at the first platform of the proximal cylinder;

a second anchor disposed at the second platform of the proximal cylinder;

a hub disposed between the proximal cylinder and the distal cylinder, the hub comprising a hub sidewall and a spoke having at least one channel;

an edible member configured to at least partially encapsulate the hub; and a cord configured to extend between the first anchor at the first platform of the proximal cylinder and the second anchor at the second platform of the distal cylinder, the cord further configured to pass through the channel of the spoke, whereby the cord is configured to twist in a first direction to generate torque and rotatably carry the hub towards the proximal cylinder, and whereby the cord is configured to twist in a second direction to release momentum from the generated torque and rotatably carry the hub towards the distal cylinder.

17. The device of claim 16, wherein the hub is rotatably carried towards the proximal cylinder and the distal cylinder at an angular velocity and a linear velocity.

18. The device of claim 17, wherein the angular velocity and the linear velocity of the hub is increased by drawing the cord taut.

19. The device of claim 18, wherein the angular velocity and the linear velocity of the hub is decreased by slackening the cord.

20. A method for operating a bottle cap spinning device, the method comprising:

providing a bottle;

containing a liquid in a bottle;

detachably capping the bottle with a bottle cap;

containing a candy or a medicine in a cavity of the bottle cap;

dispensing the candy or medicine through at least one gate of the bottle cap;

separating the bottle cap into a proximal cylinder, a distal cylinder, and a hub, the hub at least partially encapsulated by an edible member;

extending a cord between the proximal cylinder and the distal cylinder;

passing the cord through a channel in a spoke of the hub;

twisting the cord in a first direction to generate torque and rotatably carry the hub towards the proximal cylinder;

twisting the cord in a second direction to release momentum from the generated torque and rotatably carry the hub towards the distal cylinder; and consuming the edible member.

* * * * *